US006956429B1

(12) United States Patent
Elbanhawy

(10) Patent No.: US 6,956,429 B1
(45) Date of Patent: Oct. 18, 2005

(54) LOW DROPOUT REGULATOR USING GATE MODULATED DIODE

(75) Inventor: Alaa Elbanhawy, Hollister, CA (US)

(73) Assignee: Fairchild Semiconductor Corporation, South Portland, ME (US)

( * ) Notice: Subject to any disclaimer, the term of this patent is extended or adjusted under 35 U.S.C. 154(b) by 0 days.

(21) Appl. No.: 10/774,581

(22) Filed: Feb. 9, 2004

(51) Int. Cl.[7] ..... G05F 1/10
(52) U.S. Cl. ..... 327/541
(58) Field of Search ..... 327/530, 534, 327/535, 537, 538, 540, 541, 543

(56) References Cited

U.S. PATENT DOCUMENTS 5,510,641 A 4/1996 Yee et al.
5,744,994 A 4/1998 Williams
5,818,084 A 10/1998 Williams
5,864,227 A * 1/1999 Borden et al. ..... 323/280
5,929,690 A 7/1999 Williams
5,982,226 A * 11/1999 Rincon-Mora ..... 327/541
5,994,950 A * 11/1999 Ochi ..... 327/543
6,133,779 A * 10/2000 Sichert et al. ..... 327/540
6,337,598 B1 * 1/2002 Ohno ..... 327/540
6,518,737 B1 * 2/2003 Stanescu et al. ..... 323/280
6,842,068 B2 * 1/2005 Perrier et al. ..... 327/540

* cited by examiner

*Primary Examiner*—Jeffrey Zweizig
(74) *Attorney, Agent, or Firm*—Sidley Austin Brown & Wood LLP

(57) ABSTRACT

A voltage regulator includes an input terminal at which an input voltage is applied and an output terminal at which an output voltage is provided to a load. The load defines a load current. A gate modulated diode is connected between the input terminal and the output terminal. The gate modulated diode has a forward voltage drop that is controllable by a voltage signal applied to a gate of the gate modulated diode. A first operational amplifier, capable of operating with a low supply voltage, is operable to apply the voltage signal at the gate of the gate modulated diode to control the forward voltage drop. The output voltage is regulated to a predetermined low voltage when the load current is within an operational range for the voltage regulator.

15 Claims, 4 Drawing Sheets

LOW DROPOUT REGULATOR USING GATE MODULATED DIODE

TECHNICAL FIELD OF THE INVENTION

This invention relates to power management, and more particularly, to a low dropout (LDO) regulator using gate modulated diode.

BACKGROUND

Many direct current (DC) electronic devices, such as integrated circuits and microprocessors, require a constant voltage within certain tolerances. One type of circuit that can be used to provide a constant voltage is a voltage regulator. The task of providing this voltage is made difficult by the small fluctuations in a voltage source, and by the variation in load current required by the DC device. Furthermore, as improvements are made in the portability and power consumption of electronic devices, the magnitude of the desired constant voltage decreases. Some electronic devices may require a voltage of less than 1V, which is regulated from a relatively small input voltage source. This further complicates and makes difficult the task of providing a constant voltage output that is suitable for many devices.

SUMMARY

According to an embodiment of the present invention, a voltage regulator includes an input terminal at which an input voltage is applied and an output terminal at which an output voltage is provided to a load. The load defines a load current. A gate modulated diode is connected between the input terminal and the output terminal. The gate modulated diode has a forward voltage drop that is controllable by a voltage signal applied to a gate of the gate modulated diode. A first operational amplifier, capable of operating with a low supply voltage, is operable to apply the voltage signal at the gate of the gate modulated diode to control the forward voltage drop. The output voltage is regulated to a predetermined low voltage when the load current is within an operational range for the voltage regulator.

According to another embodiment of the present invention, a voltage regulator includes an input terminal to which a low source voltage can be applied and an output terminal at which a low output voltage is provided. A transistor is connected between the input terminal and the output terminal. The transistor has a forward voltage drop which can be changed in response to a voltage applied to a gate of the transistor. Means connected to the gate of the transistor controls the forward voltage drop of the transistor so that the low voltage output is maintained at a substantially constant value. The means for controlling is capable of operating with the low source voltage.

Important technical advantages of the present invention are readily apparent to one skilled in the art from the following figures, descriptions, and claims.

BRIEF DESCRIPTION OF THE DRAWINGS

For a more complete understanding of the present invention and for further features and advantages, reference is now made to the following description taken in conjunction with the accompanying drawings, in which.

DETAILED DESCRIPTION

The embodiments of the present invention and their advantages are best understood by referring to FIGS. 1 through 6 of the drawings. Like numerals are used for like and corresponding parts of the various drawings.

Figure 1:
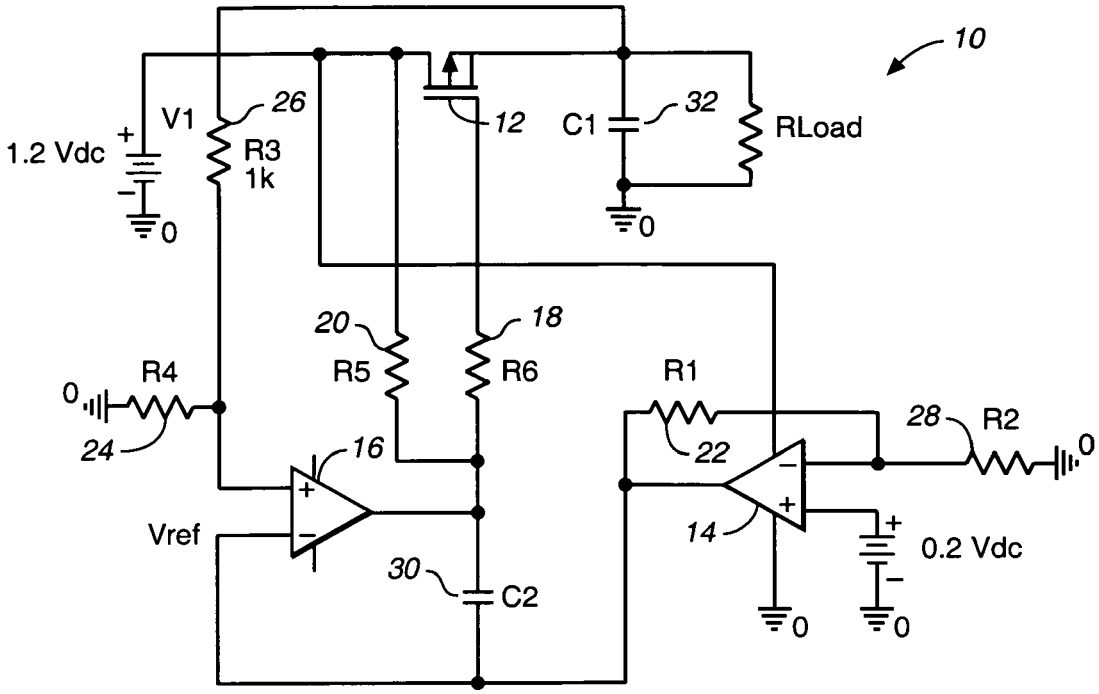
FIG. 1 is a schematic diagram of a low dropout (LDO) voltage regulator, according to an embodiment of the present invention.

FIG. 1 is a schematic diagram of a low dropout (LDO) voltage regulator 10, according to an embodiment of the present invention. LDO voltage regulator 10 has an input terminal at which it receives an input source voltage V1. The source voltage V1 can be relatively low (e.g., 1.2 V). An output voltage for LDO voltage regulator 10 appears at an output terminal. A load (Rload) which may be coupled to the output terminal defines a load current for LDO voltage regulator 10. LDO voltage regulator 10 generally functions to accurately regulate the output voltage to within a relatively low, predetermined magnitude (e.g., 0.8V) even as the amount of load current varies within an operational range (e.g., 0 to 4.0 amps) depending on the value of Rload.

As depicted, LDO voltage regulator 10 includes a transistor 12, a first operational amplifier 14, a second operational amplifier 16, resistors 18, 20, 22, 24, 26, and 28 and capacitors 30 and 32. Capacitor 32, which can be a discrete component with a value of 100 $\mu$F, functions to stabilize the output voltage when the load current changes rapidly. Capacitor 32 may have a suitable equivalent series resistance (ESR) value, which affects how current is supplied by the capacitor and how quickly it can respond to variations in load current.

Transistor 12 may function as a series pass transistor through which current flows from the input terminal to the output terminal of the LDO voltage regulator 10. Transistor 12 can be implemented using any suitable transistor, such as, for example, a P-channel metal-oxide-semiconductor field effect transistor (MOSFET) in one embodiment. Transistor 12 can be implemented with any suitable device, such as, for example, a P-channel transistor (e.g., product no. FDS4465 available from Fairchild Semiconductor Corp.).

The body of transistor 12 can function as a diode which allows current to flow in one direction but not the other. In other words, MOSFETs have a built-in body diode capable of conducting full MOSFET drain current. The transistor may have a voltage drop (e.g., greater than 0.6 V) in the direction of current flow. The voltage drop across the diode body is controlled by the gate-source voltage of transistor 12 when the voltage applied to the gate is less than the threshold voltage Vth of the transistor 12. That is, with respect to the region under the gate threshold voltage Vth, changing the voltage applied to the gate of the transistor 12 results in a change of the forward voltage drop. Experiments have shown that the voltage drop across the body diode while it is conducting current may be considerably reduced by applying an appropriate voltage to the gate at a voltage level below that of the gate threshold voltage Vth. As such, the diode implemented by transistor 12 may be considered a gate modulated diode (GMD)—the voltage drop may be modulated by the gate voltage to achieve a desirable voltage drop performance. The voltage across this GMD can be controlled to have very low dropout (LDO) voltage—e.g., less than 1 volt. In some embodiments, the voltage drop across the body diode of transistor 12 can be reduced to values better than Schottky rectifiers. For example, in some applications, the forward voltage drop across the GMD can be a relatively low value of 0.4V. An exemplary structure and more detailed discussion of the operation and application of a transistor as a GMD is provided below with reference to FIGS. 4 through 6.

In some embodiments, the voltage at the gate of transistor 12 is dependent on or controlled in response to the load current, thus providing the best output voltage regulation for the load current from relatively light to relatively full amounts (e.g., 0.0–4.0 A). As depicted, the gate of transistor 12 is controlled at least in part by operational amplifiers 14 and 16, resistors 18 and 20, and capacitors 30 and 32. Feedback for the load current to the control circuitry may be provided by a connection from the output terminal of the LDO voltage regulator 10 (at which the Rload appears) and the non-inverting input terminal of operational amplifier 16.

Operational amplifiers 14 and 16 are preferably operational amplifiers which can operate from a single power cell with a relatively small amount of total supply voltage (e.g., as low as 1.0V) and drawing a relatively small amount of current (e.g., 300 $\mu$A or less). In one embodiment, operational amplifiers 14 and 16 can be implemented with one or more suitable components, such as, for example, product no. LM10C available from National Semiconductor Corp.

Resistor 18, which may have a value of 50 ohms, functions to reduce, minimize, or altogether stop oscillation at the gate of transistor 12. Capacitor 30 functions to limit the bandwidth for LDO voltage regulator 10. In one embodiment, capacitor 30 may have a value of 100 nF. One end of capacitor 30 is connected to the output terminal of operational amplifier 14, and the other end of capacitor 30 is connected to the output terminal of operational amplifier 16.

Operational amplifier 14 may develop a reference voltage Vref from an internal voltage source which is connected to its non-inverting (+) input terminal. The inverting (−) input terminal of operational amplifier 14 may be connected to its output terminal through resistor 22 and to ground through resistor 28. The value of the reference voltage Vref can be configured based on the values of the internal voltage source and the resistors 22 and 28. For example, in one embodiment, the internal voltage source may have a value of 0.2V and resistors 22 and 28 may each have a value of 10 kohms.

Resistors 24 and 26 implement a voltage divider which divides the voltage appearing at the output terminal of the voltage regulator 10. In one embodiment, each of resistors 24 and 26 may have a value of 1 kohm, in which case, the voltage at this terminal is evenly divided. The divided voltage can be a feedback signal for the load current.

Operational amplifier 16 receives the reference voltage (e.g., output of operational amplifier 14) at its inverting (−) input terminal and the feedback signal at its non-inverting (+) input terminal. The output of operational amplifier 16 is applied to the gate of the transistor 12 (acting as a GMD) to adjust its forward voltage drop responsive to the load current. Resistor 20 provides pull-up at the output node of operational amplifier 16.

In use, LDO voltage regulator 10 regulates the relatively small input voltage (e.g., 1.2V) to output a constant low output voltage (e.g., 0.8V) at its output terminal where Rload appears. More specifically, transistor 12 operates as a gate modulated diode (GMD) having a relatively low forward voltage drop which varies depending on the voltage applied to its gate. As Rload may change, thus causing the output current to change, the voltage applied to the gate of the GMD is changed so that the forward voltage drop across the diode is adjusted to maintain the output voltage at a consistent, desired level.

Thus, if the Rload at the output terminal decreases, the output voltage would decrease. This decrease in the output voltage is fed back to the operational amplifier 16 as a signal developed across resistor 24. Operational amplifier 16 compares the feedback signal to the reference voltage Vref developed by operational amplifier 14. This causes a decrease in the output of operational amplifier 16 which is applied to the gate of transistor 12 acting as a GMD. The forward voltage drop of the GMD is lowered, thus causing the output voltage of the voltage regulator to increase back to the desired level.

Alternatively, if the Rload at the output terminal increases, the output voltage would increase. This increase in the output voltage is fed back to the operational amplifier 16 as a signal developed across resistor 24. Operational amplifier 16 compares the feedback signal to the reference voltage Vref developed by operational amplifier 14. This causes an increase in the output of operational amplifier 16 which is applied to the gate of the GMD. The forward voltage drop of the GMD is raised, thus causing the output voltage of the voltage regulator to decrease back to the desired level.

Unlike previously developed systems, LDO voltage regulator 10 does not require higher voltage values (e.g., 3.3V or higher) and more complex circuitry in order to provide a relatively low output voltage (e.g., 1.0V or less). Instead, voltage regulator 10 can be relatively simple circuitry, such as the exemplary implementation shown and described with reference to FIG. 1, operating with relatively low input voltage (e.g., 1.2V). This is accomplished in part, for example, by using operational amplifiers 14 and 16 which are configured or selected to operate with relatively low voltage values (e.g., 1.2V or less). Thus, there is no need for additional voltage sources of higher value, or more circuitry (e.g., boost circuit) to generate a higher voltage from the relatively low input voltage.

LDO voltage regulator 10 can be implemented on a single integrated circuit (IC) chip, multiple IC chips, or alternatively, in discrete components. For example, in one embodiment, the transistor 12 can be implemented with any suitable device, such as, for example, a P-channel transistor (e.g., product no. FDS4465 available from Fairchild Semiconductor Corp.). Likewise, operational amplifiers 14 and 16 can be implemented with one or more suitable components, such as, for example, product no. LM10C available from National Semiconductor Corp.

In one embodiment, LDO voltage regulator 10 can be implemented with only three terminal connections: input voltage (Vin), output voltage (Vout), and ground (GND). This is advantageous over previously developed regulators which require at least four or more terminal connections—i.e., the three mentioned immediately above, as well as a terminal for a higher voltage source which is needed for the proper operation of control circuitry in the previously developed regulators.

In one embodiment, LDO voltage regulator 10 can deliver up to 3.5 A at 0.8V from a 1.2V input source. Furthermore, LDO voltage regulator 10 provides a high degree of regulation (e.g., in terms of percentage variation or tolerance). This is shown and described in more detail with references to FIGS. 2 and 3.

Figure 2:
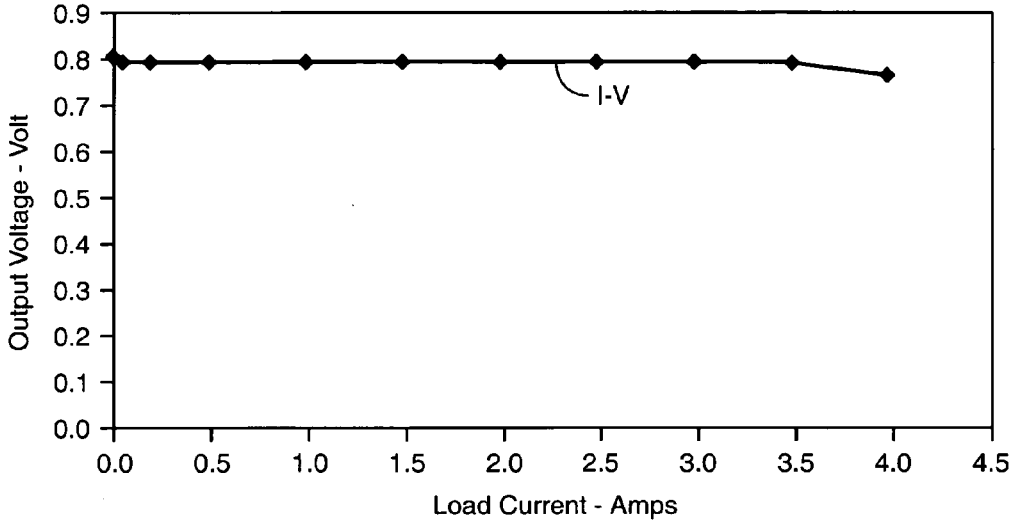
FIG. 2 is a chart illustrating the output voltage versus load current for a LDO voltage regulator, according to an embodiment of the present invention.

FIG. 2 is a chart illustrating the output voltage versus load current for a LDO voltage regulator 10, according to an embodiment of the present invention. As shown, the output voltage for voltage regulator 10 is regulated to a relatively constant value less than 1 volt (e.g., 0.8V) for a useful range of load current (e.g., 0 to 3.5 A or even 4 A).

Figure 3:
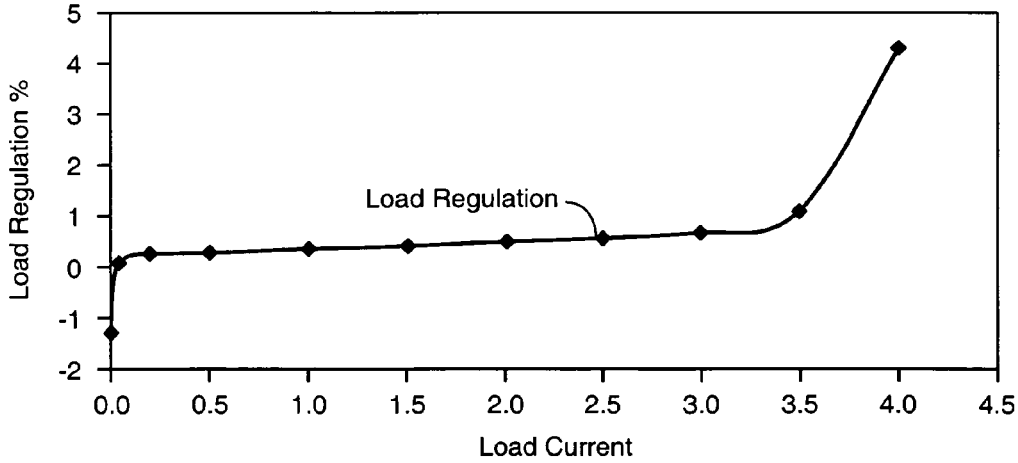
FIG. 3 is a chart illustrating the percentage of load regulation versus load current for a LDO voltage regulator, according to an embodiment of the present invention.

FIG. 3 is a chart illustrating the percentage of load regulation versus load current for a LDO voltage regulator, according to an embodiment of the present invention. As shown, the voltage regulation provided by LDO voltage regulator 10 may be better than 1% for up to 3.5 A of load current.

Figure 4:
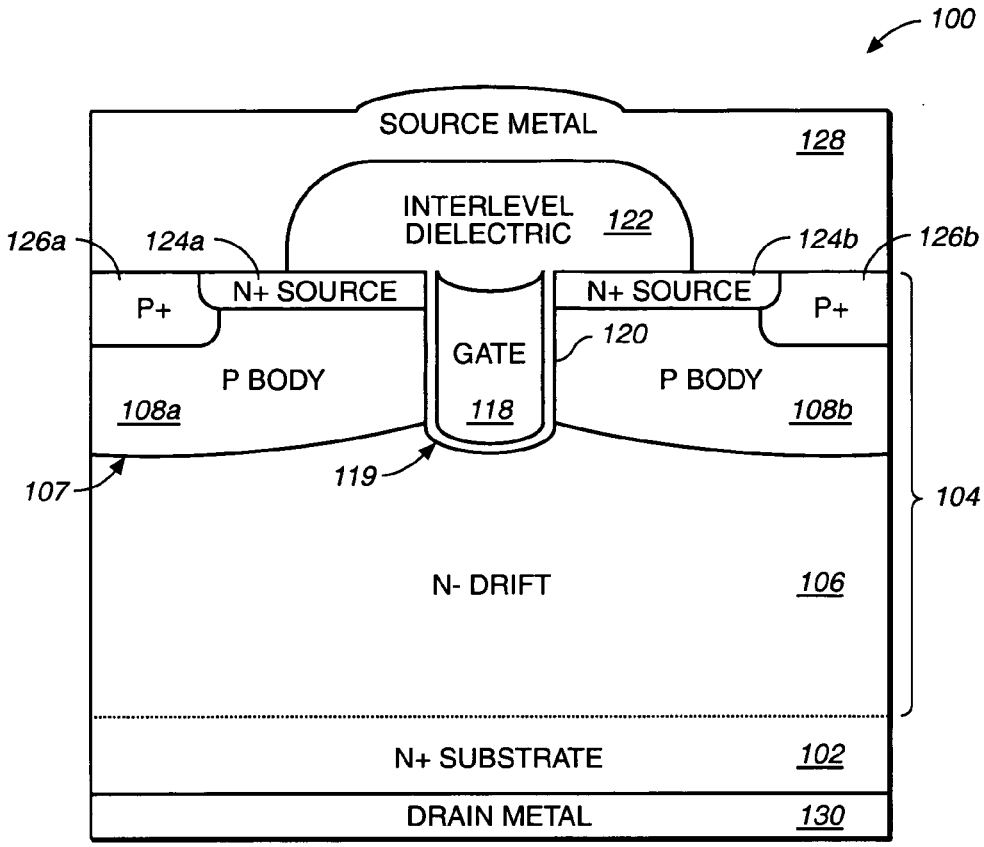
FIG. 4 illustrates a structure for a gate modulated diode.

FIG. 4 illustrates a structure for a gate modulated diode (GMD) 100. GMD 100 can be a p-channel, trench gate MOSFET. Such GMD 100 can be used as a rectifier and has a built-in body diode. In such MOSFET rectifiers, the built-in body diode conducts the full MOSFET drain current, and the voltage drop across the body diode is similar to that of a PN diode. The voltage drop across the body diode can be advantageously reduced from that of a PN diode by applying suitable voltages—e.g., positive voltages in the range of between 0V and the gate threshold voltage Vth in an N-channel MOSFET.

Referring to FIG. 4, the body diode of GMD 100 is made up of p-type body region 108 and n-type drift region 106. To cause the body diode to conduct, a higher potential is applied to the source (at source metal 128) than that applied to the drain (at drain metal 130). With source regions 124*a* and 124*b* and body regions 108*a* and 108*b* electrically shorted together, the higher body potential forward biases the body diode. To achieve rectification, the gate voltage is maintained below the gate threshold voltage Vth to prevent the MOSFET from conducting for positive drain-source voltages Vds. With the gate-source voltage Vgs=0V, the forward drop across the diode-operated MOSFET is the same as a PN diode. The forward voltage drop is significantly reduced by applying to the gate a positive voltage in the range of between 0V and gate threshold voltage Vth.

Figure 5:
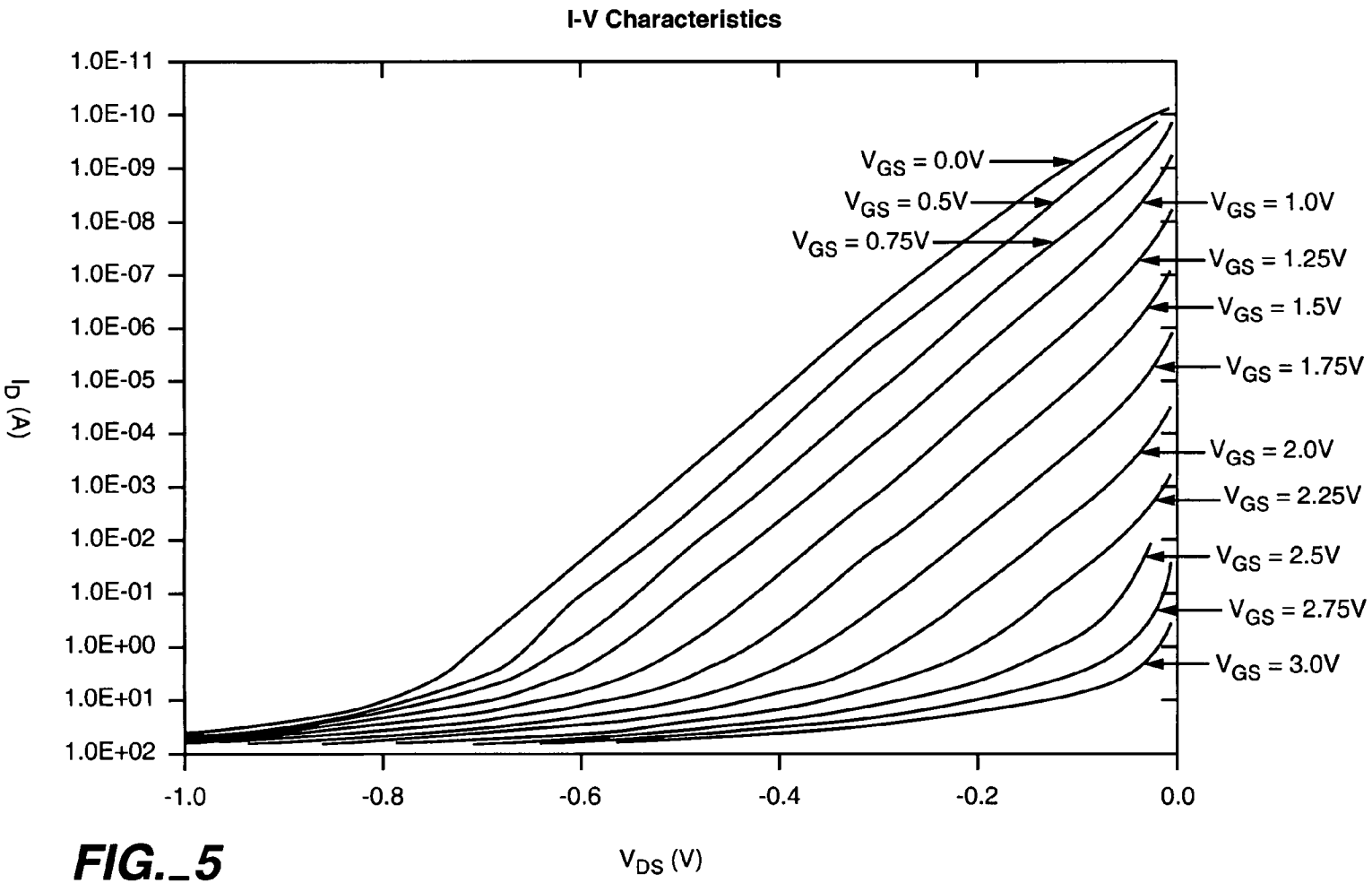
FIG. 5 is a chart illustrating the current-voltage characteristics of a MOSFET when operated as a gate modulate diode.

FIG. 5 is a chart illustrating the current-voltage (I-V) characteristics of a MOSFET when operated as a GMD. The vertical axis represents the drain current Id and the horizontal axis represents the drain-source voltage Vds of the transistor. The curves show the I-V characteristics for gate voltages ranging from 0V to 3V. As shown by these curves, the voltage drop across the transistor reduces as the gate voltage is increased from 0V. The same I-V characteristics have been observed in p-channel MOSFETs.

Figure 6:
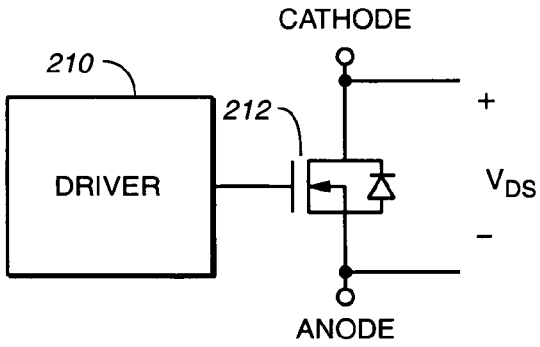
FIG. 6 is a schematic diagram in partial block form of an application for a gate modulated diode.

A number of low power, high frequency applications are possible in view of the particular characteristics of the GMD or diode-operated MOSFET shown in FIG. 5. FIG. 6 is a schematic diagram in partial block form of a general application in which the GMD is used to take advantage of the particular characteristics. In FIG. 6, a GMD or diode-operated MOSFET 212 is shown with the drain serving as the cathode terminal and the source serving as the anode terminal. The gate is biased by a driver block 210. Driver block 210 operates to modulate the gate voltage to obtain a precisely controlled forward voltage drop across MOSFET 212. That is, during operation, the gate biasing is modulated to increase or decrease the voltage drop as needed. This may be achieved by detecting the voltage across or the current through the MOSFET and in response adjusting the gate voltage to increase or decrease the forward voltage drop.

As described herein, the LDO voltage regulator 10 is a elegant solution for providing a relatively low (e.g., less than 1.0V) voltage output which does not require multiple voltage sources and complex circuitry to implement. Compared to previously developed designs, the LDO voltage regulator 10 is simple, efficient, and easily implemented with a minimal number of parts or discrete components.

Although the present invention and its advantages have been described in detail, it should be understood that various changes, substitutions, and alterations can be made therein without departing from the spirit and scope of the invention as defined by the appended claims. That is, the discussion included in this application is intended to serve as a basic description. It should be understood that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Neither the description nor the terminology is intended to limit the scope of the claims.

What is claimed is:

1. A voltage regulator comprising:

an input terminal at which an input voltage is applied;

an output terminal at which an output voltage is provided to a load, wherein the load defines a load current;

a gate modulated diode connected between the input terminal and the output terminal, the gate modulated diode having a forward voltage drop that is controllable by a voltage signal applied to a gate of the gate modulated diode, wherein the gate modulated diode comprises a transistor operating at below gate threshold voltage;

a first operational amplifier capable of operating with a low supply voltage, the first operational amplifier operable to apply the voltage signal at the gate of the gate modulated diode to control the forward voltage drop;

wherein the output voltage is regulated to a predetermined low voltage when the load current is within an operational range for the voltage regulator.

2. The voltage regulator of claim 1 wherein the supply voltage has a value of not more than 1.2V.

3. The voltage regulator of claim 1 wherein the gate modulated diode comprises a MOSFET.

4. The voltage regulator of claim 1 wherein the supply voltage is the same as the input voltage.

5. The voltage regulator of claim 1 wherein the output voltage has a value of not more than 1.0V.

6. The voltage regulator of claim 1 comprising a second operational amplifier operable to provide a reference voltage to the first operational amplifier.

7. The voltage regulator of claim 1 comprising a resistor coupled between the input terminal and an output node of the first operational amplifier, the resistor operable to pull-up the output node of the first operational amplifier.

8. The voltage regulator of claim 1 comprising a capacitor connected to the output terminal, the capacitor operable to stabilize the output voltage.

9. A voltage regulator comprising:

an input terminal to which a low source voltage can be applied;

an output terminal at which a low output voltage is provided;

a transistor operating at below gate threshold voltage and connected between the input terminal and the output terminal, the transistor having a forward voltage drop which can be changed in response to a voltage applied to a gate of the transistor; and means connected to the gate of the transistor for controlling the forward voltage drop of the transistor so that the low voltage output is maintained at a substantially constant value, the means for controlling capable of operating with the low source voltage.

10. The voltage regulator of claim 9 wherein the low source voltage has a value of not more than 1.2V.

11. The voltage regulator of claim 9 wherein the transistor implements a gate modulated diode.

12. The voltage regulator of claim 9 wherein the transistor comprises a MOSFET.

13. The voltage regulator of claim 9 wherein the output voltage has a value of not more than 1.0V.

14. The voltage regulator of claim 9 wherein the means for controlling comprises an operational amplifier.

15. The voltage regulator of claim 9 comprising a capacitor connected to the output terminal, the capacitor operable to stabilize the output voltage.

* * * * *